United States Patent [19]

Kaegebein

[11] 4,186,359

[45] Jan. 29, 1980

[54] NOTCH FILTER NETWORK

[75] Inventor: Daniel P. Kaegebein, Depew, N.Y.

[73] Assignee: TX RX Systems Inc., Angola, N.Y.

[21] Appl. No.: 826,412

[22] Filed: Aug. 22, 1977

[51] Int. Cl.[2] ..... H01P 7/04; H01P 7/06; H01P 1/20

[52] U.S. Cl. ..... 333/134; 333/207; 333/223; 333/234

[58] Field of Search ..... 333/73 C, 73 R, 73 W, 333/6, 70 R, 82 R, 82 BT, 83 R, 83 A, 202–212, 132, 134–137, 227–233, 235, 234, 13

[56] References Cited

U.S. PATENT DOCUMENTS

| | | | |
|---|---|---|---|
| 3,624,563 | 11/1971 | Burley et al. | 333/73 C X |
| 3,733,567 | 5/1973 | Johnson | 333/82 B |
| 3,733,608 | 5/1973 | McGhay et al. | 333/73 R |
| 3,815,137 | 6/1974 | Kaegebein | 325/23 X |
| 3,876,963 | 4/1975 | Graham | 333/73 R |
| 4,037,177 | 7/1977 | Tyrey | 333/70 R X |
| 4,075,583 | 2/1978 | Kershaw | 333/82 B X |
| 4,080,601 | 3/1978 | Alcorn, Jr. | 333/6 X |

*Primary Examiner*—Paul L. Gensler
*Assistant Examiner*—Marvin Nussbaum
*Attorney, Agent, or Firm*—Bean, Kauffman & Bean

[57] ABSTRACT

An electrical filter network with improved characteristics is disclosed for selectively attenuating and passing two different, closely spaced frequencies. The notch filter network includes a low Q reactive circuit tuned to be parallel resonant at the frequency to be attenuated. A cavity resonator with a high Q is inductively coupled to the reactive circuit and is tuned to be resonant at the frequency to be passed. Utilizing these concepts, a multicoupler may be constructed to consist of two or more such filter networks in combination with a transmission line. In such a multicoupler, the network adjacent to the antenna terminal is separated therefrom by a multiple of a half wavelength. Additional filter networks are separated from one another by an odd number of a quarter wavelength. With this arrangement, each network passes a band around the frequency to which the high Q cavity is tuned and rejects a band of frequencies around the reactive circuit resonant frequency.

31 Claims, 12 Drawing Figures

Fig. 2.
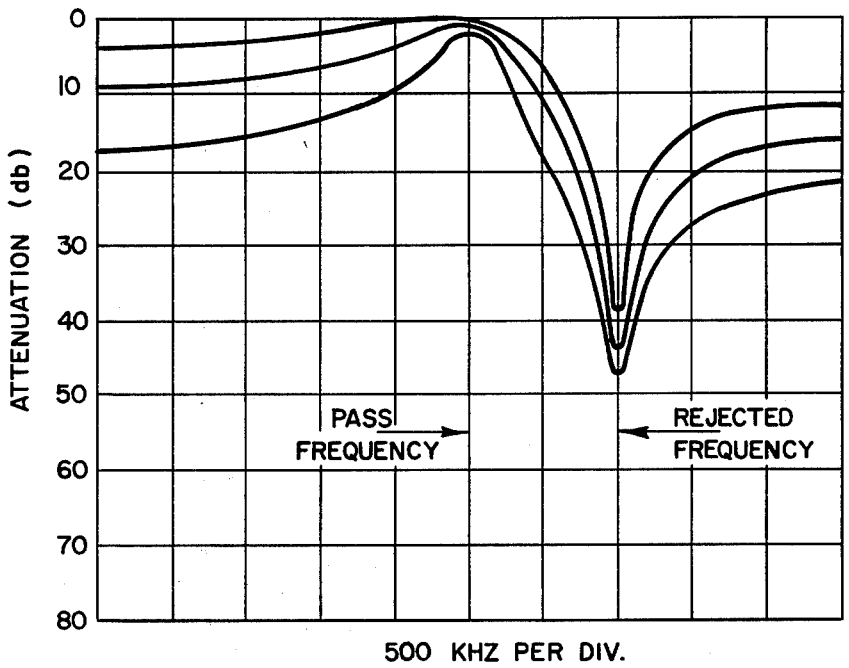
Fig. 3.
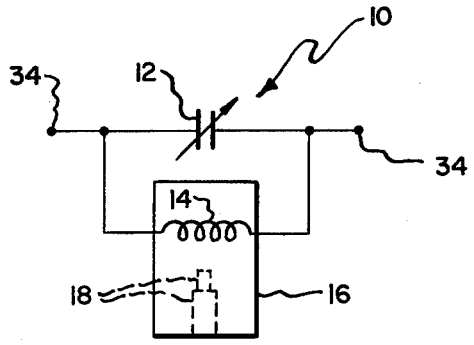
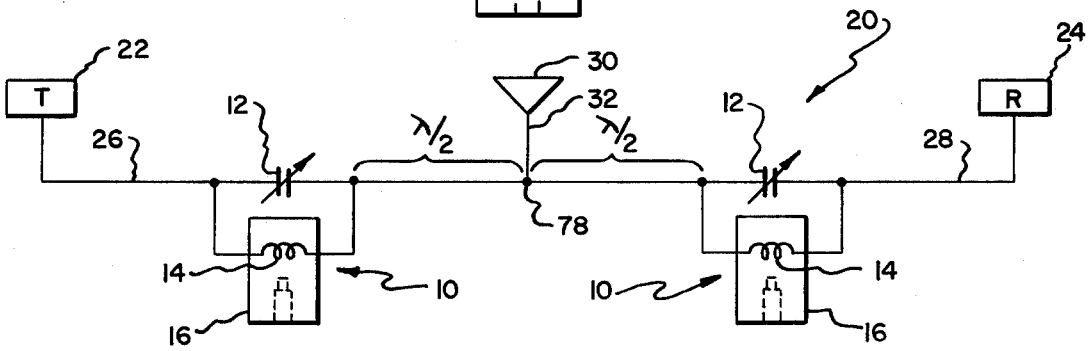
Fig. 4.

NOTCH FILTER NETWORK

BACKGROUND OF THE INVENTION

1. Field of the Invention

The present invention relates to electrical filter networks for filtering selected frequencies. More specifically, the present invention relates to notch filter networks which utilize, in combination, a high Q cavity filter and a low Q lumped constant filter network to produce an electrical filter network of improved characteristics. The present invention also relates to multicouplers such as diplexers and duplexers which include the filter network of the present invention. Accordingly, the general objects of the present invention are to provide novel and improved apparatus and methods of such character.

2. The Prior Art

In my prior patents, Ser. Nos. 3,717,827 and 3,815,137 issued on Feb. 20, 1973 and June 4, 1974, respectively, interference problems in the field of radio communications were discussed. Briefly, these problems involve the simultaneous utilization of one antenna or transmission line with two or more transmitting and receiving pieces of equipment operating at carrier signals of different frequencies such as are found in diplexers and duplexers. In a diplexer at least two receivers or two transmitters share an antenna. In a duplexer, which is the more difficult of the two, at least one receiver and one transmitter share the same antenna. In order to properly isolate the various pieces of equipment from one another, a number of filter sections are commonly utilized. These filter sections each reject a first frequency and pass a second frequency. It is desirable for these filter sections to be easily tuneable to vary either the pass or reject frequencies. It is also desirable, in certain applications, to have as broad a reject band as possible to reduce the number of filters required to properly isolate the equipment. The goal of attaining a broad reject band, however, should not sacrifice the selectivity of the filter so as to adversely effect the proximity of the reject band and the pass band which should be as close together as possible. Furthermore, it is always commercially desirable for the filter device to be of simple, straight forward construction so that it might be easily manufactured at relatively small cost. It is also desirable that the filter have a high operating efficiency.

Other filtering devices are known which satisfy these objects to one degree or another. One such filtering device is described in U.S. Pat. No. 3,876,963 issued on Apr. 8, 1975 to Gerald Graham. Still other notch filtering devices may be found described in U.S. Pat. Nos. 3,680,011; 3,697,903; 3,967,102; and 3,925,739. Each of these devices has one or more drawbacks. Therefore, it is apparent that an inexpensive and flexible notch filter is needed to adequately solve many of the problems of radio frequency interference found in multicouplers.

SUMMARY OF THE INVENTION

Such a filter has been discovered and is the subject of the present invention. The notch filter network herein disclosed and described includes a lumped constant resonant circuit of low Q in combination with a quarter wave resonant cavity having a high Q. The resonant circuit is of the parallel type having a capacitor and an inductor in parallel. The resonant circuit and the resonant cavity are coupled by inductive coupling. Thus, the inductor of the resonant circuit, or a portion thereof, is inserted into the interior of the resonant cavity. The combination notch filter circuit is then connected in series into a transmission line.

With the above outlined configuration, the lumped constant resonant circuit behaves like a high series impedance at its resonant frequency to provide the rejection notch. The resonant cavity, on the other hand, at its resonant frequency, couples into the inductive arm of the lump constant resonant circuit, and causes the inductive arm to appear as a series resonant circuit, producing a pass band with very little impedance (or insertion loss) and with a definite pass band roll-off. It is, in part, due to the pass band roll-off characteristic of the present invention which permits the construction of a multi-coupler having excellent broad band isolation characteristics between equipment terminals. The broad band isolation is also enhanced by the relatively sharp selectivity between pass band and reject band of a single notch filter network.

The notch filter of the present invention has the ability to be varied in a number of respects. The lumped constant parallel resonant circuit may be provided with a variable capacitor so that the frequency of the notch or of the reject band can be varied. Additionally, the resonant cavity in its preferred form is a coaxial cavity with an axial conductor whose length may be changed in order to vary the frequency of the pass band. Finally, the inductor of the lumped constant circuit is moveably mounted within the cavity in order to permit variation of the mutual inductive coupling between the inductor and the field of the cavity. As the intensity of the field of the cavity linking the inductor is reduced or, as the effective cross-sectional area of the inductive coupling between the inductor and the cavity is reduced, the cavity resonator is permitted to operate at an increased circuit Q which in turn permits the pass band and notch frequencies to be tuned in closer proximity. This also results in a wider notch and improved selectivity about the pass band at the cost of increased insertion loss at the pass frequency.

Multicouplers, whether they be of diplexer or duplexer form, may be assembled utilizing this novel notch filter circuit. Accordingly, one notch filter network of the present invention is coupled in series into each of the transmission lines leading to the various pieces of equipment. Each coupling is made in spaced relationship at a multiple of a half wavelength of the pass frequency of the opposite transmission line from the common antenna terminal. Additional networks may be added in series to the transmission lines at odd multiples of quarter wavelengths of such frequency from one another. The broad notches or reject bands, the relatively small insertion losses, and the excellent selectivities of the component notch filter networks all combine to yield a multicoupler which is superior to those assembled from prior art filters.

According to one embodiment of the present invention, a coaxial resonant cavity with a variable length center line conductor is provided with a rotatable inductor which penetrates into the field of the cavity. The inductor is arranged in parallel with a variable capacitor which in turn may be connected in series with the center conductor of a coaxial transmission line. In a modification of this embodiment, the capacitance consists of a fixed capacitance and a relatively small variable capacitance.

According to another embodiment of the present invention, the center line conductor of the resonant cavity is constructed to include a helical coil. The helical coil is mounted on an axially slideable member whose position is determined by the thermal expansion characteristics of a positioning post whose position may be variably adjusted. By this means, thermal drift effects on the pass and notch frequencies may be reduced if not eliminated altogether.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which:

FIGS. 2 is a graphical illustration showing an example of the characteristic performance curves of a notch filter network according to the present invention with three different values of inductive coupling between the lumped constant circuit and the resonant cavity;

FIG. 3 is a semi-schematic representation of the notch filter network of the present invention;

FIG. 4 is a semi-schematic representation of a simple multicoupler utilizing the notch filter network of the present invention;

DESCRIPTION OF THE PREFERRED EMBODIMENT

Figure 1A:
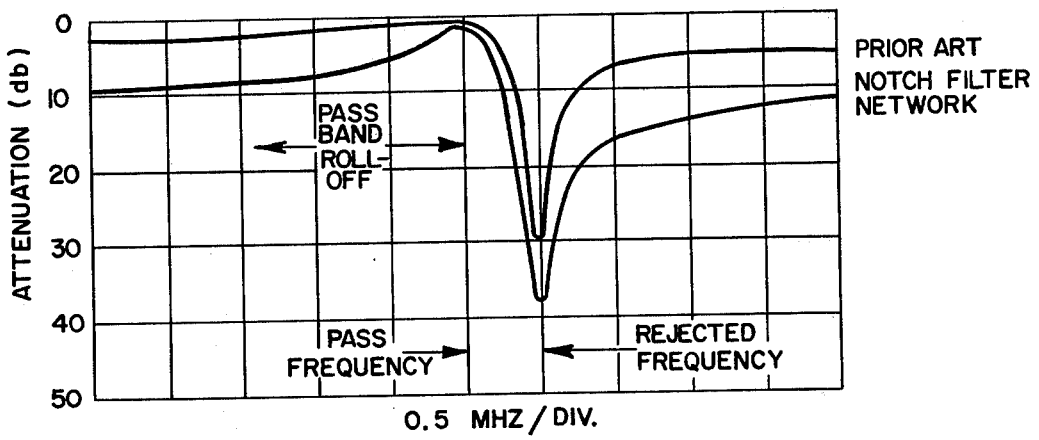
FIG. 1*a*, 1*b* and 1*c* are graphical illustrations of a series of characteristic performance curves showing a comparison between a typical prior art notch filter circuit and the notch filter network of the present invention.

Having reference to the drawings wherein like parts are designated by the same reference numeral throughout the several views, the present invention is illustrated in FIG. 3 as comparising a variable capacitor 12 electrically connected in parallel with an inductance 14, said inductance being physically positioned within a resonant cavity 16 and inductively coupled thereto. In this arrangement, the capacitor-industance combination constitutes a lumped constant reactive circuit which may be tuned to be parallel resonant at a first predetermined frequency by changing the capacitance of capacitor 12. Cavity resonator 16 may be of any suitable type such as an adjustable micro-wave transmission cavity or a coaxial cavity, as illustrated, having a central lengthwise adjustable conductor 18 provided for tuning the cavity to a second predetermined resonant frequency. Conventional cavities such as quarter wave cavities or odd multiples of quarter wave cavities are suitable for this application. The reactive circuit comprising capacitor 12 and inductor 14 is adapted to be connected in series with a transmission line by means of non-directional circuit connectors 34.

As will be understood from a consideration of the properties of a resonant cavity and the properties of a parallel resonant lumped constant circuit in a transmission line, the lumped constant circuit behaves as a high series impedance at the first predetermined resonant frequency to produce the desired notch or rejection band. While a typical prior art lumped constant notch circuit consisting of a parallel circuit including an inductance and a capacitance connected in series in a transmission line has the desirable characteristic of a broad notch of isolation, a typical low Q lumped constant notch circuit also has the undesireable characteristic of producing a pass frequency which is spread out over a relatively large distance from the tuned notch frequency. This difficulty is overcome by the present invention with the novel combination of a resonant cavity inductively coupled to the inductance of the low Q lumped constant notch circuit. In this combination, the high Q cavity overrides the characteristics of the low Q lumped constant notch circuit when the frequency is at the tuned frequency of the cavity so that the inductive arm of the low Q lumped constant notch circuit appears as a series resonant circuit at the tuned cavity resonator frequency thereby producing the pass band of the combined circuit. Since a high Q resonator is quite selective so that it has the ability to switch from one stage to another with a small change in frequency, the combined circuit of the present invention has the advantage of providing both the desirable broad notch characteristics of the low Q parallel resonance circuit in series with the transmission line and a high Q cavity resonator combining to produce a filter with a unique response which has a narrow pass band closely separated from a relatively broad rejection notch. In this combination, the cavity in effect acts as a switching element whereby through the mutual inductive coupling between the two resonators, the inductive arm of the low Q circuit appears as a series resonant circuit at the tuned cavity resonant frequency.

Figure 1B:
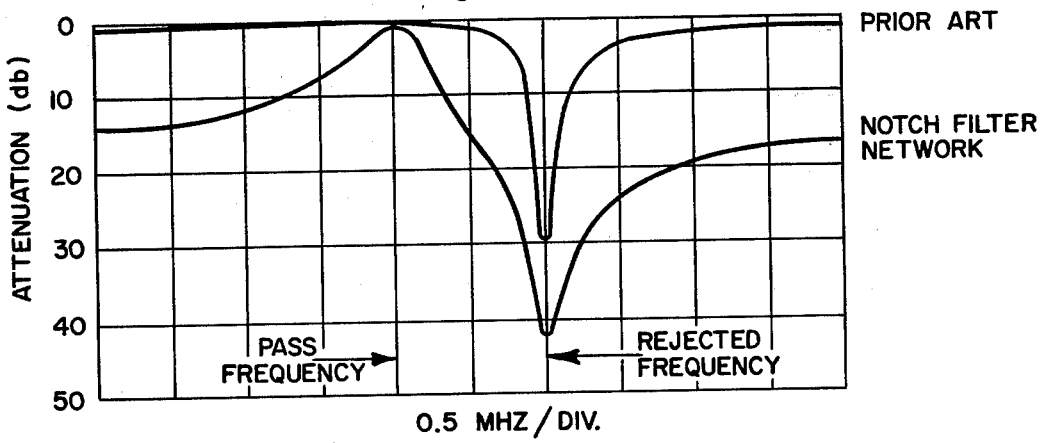
Figure 1C:
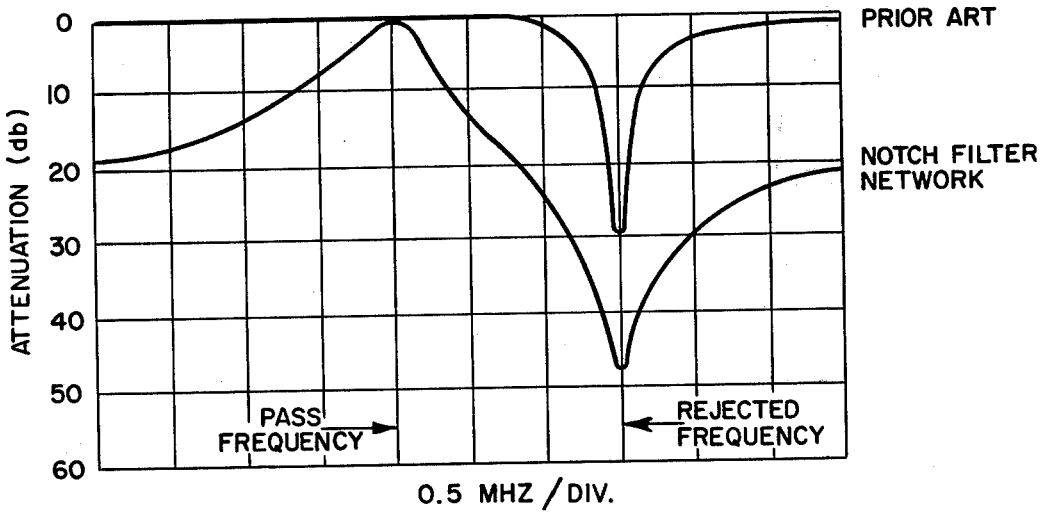

FIGS. 1*a*, 1*b* and 1*c* graphically illustrate a series of performance characteristic curves showing a comparison between a typical prior art notch filter and the notch filter network of the present invention. The curves which illustrate the behavior of the network of the invention were generated using a six and five eights inch ($6\frac{5}{8}$ in.) diameter cavity which was electrically tuned to be resonant in the one hundred and sixty megahertz region of the spectrum (160 $MH_z$). FIG. 1*a* shows a x0.5 megahertz separation between pass and reject frequencies while FIGS. 1*b* and 1*c* show a one megahertz (1 $MH_z$) and a one and one half megahertz (1.5 $MH_z$) separation respectively. It is of importance in this comparison to note that in all three illustrations, the reject notch of the notch filter network of the present invention has a greater attenuation and covers a broader band than the prior art. Additionally, the pass band of the notch filter network of the present invention rolls off much more rapidly than the prior art. And finally, it can be seen that as the signal frequency is increased from the pass frequency toward the reject frequency, the attenuation increases much more rapidly in the case of the notch filter network of the present invention than in the case of the prior art: a factor which is instrumental in permitting combination of notch filter networks to form a multicoupler having superior terminal-to-terminal isolation.

A particularly novel aspect of the present invention is that it provides the flexibility to vary the capability of the notch filter network so that the pass band and notch frequencies can be tuned in closer proximity while at the same time resulting in a generally wider rejection notch and improved selectivity about the pass band. This capability is accomplished by providing a means for reducing the inductive coupling between the inductance 14 and the cavity 16, and is accompanied by a slightly greater loss at the pass frequency. Conversely, increasing the coupling between the resonator 16 and the inductance 14 reduces the insertion loss at the pass frequency but generally results in a narrower notch with decreased selectivity about the pass band. These effects may be seen in FIG. 2 in which is illustrated three different curves for the same notch filter network of the invention which differ in the degree of inductive coupling existing between the inductance 14 and the cavity 16. The three curves have 0.2, 0.4 and 0.8 decibel injection loss respectively and each represents a filter network tuned to have a one megahertz (1 $MH_z$) separation between the pass and reject frequencies.

Figure 5:
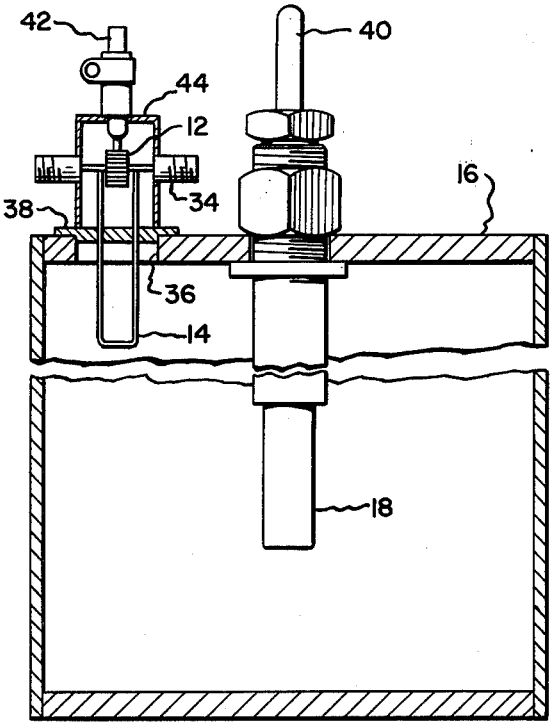
FIG. 5 is a side elevation of one embodiment of the invention showing a coaxial resonant cavity and a lumped constant resonant circuit inductively coupled thereto.

The ability to vary the inductive coupling between the inductance 14 and the cavity 16 is provided by means which permits the variation of the position of the inductor within the cavity whereby the amount of field linked by the inductor within the cavity may be increased or decreased. In a preferred embodiment this means for permitting the variation of position includes a means for permitting inductor 14 to be rotated within cavity 16 so that the plane of the loop of the conductor of inductor 14 lying in the radial plane of the coaxial cavity 16 may be rotated to form an angle therewith. Accordingly, in the preferred embodiment, where the inductance 14 constitutes a loop of conductor projecting down into the cavity 16 from one end thereof, the conductor is mounted on a circular and rotatable support disk as shown in FIG. 5. While the preferred embodiment includes rotatably mounting the inductor 14 so that it may be changed in its orientation within the cavity 16, the invention also encompasses other arrangements in which the field linked by the inductor 14 may be varied. Accordingly, the inductive coupling between the cavity and inductor 14 may be varied by changing the position of the inductor by moving the location of the inductor 14 or possibly by withdrawing and inserting the inductor 14 out from and into the cavity 16 respectively.

Turning now to a consideration of FIG. 5, the notch filter network of the present invention is illustrated in a physical embodiment as opposed to the semi-schematic embodiment previously illustrated in FIG. 3. As can be seen, the inductance 14 extends into and is located in cavity 16 and is connected at opposite ends to conductors which meet with non-directional circuit connectors 34. These conductors also connect to a variable capacitor 12 whose adjustment may be accomplished through the rotation of the capacitor tuning dielectric rod 42. As may be seen, housing 44 is provided to shield the lumped constant circuit and the whole assembly is mounted on circular support disk 38 which is in turn mounted to cover circular hole 36. As may be appreciated, any satisfactory attaching means such as screws whose heads overlap the disk 38 may be utilized to reasonably clamp the disk 38 in a fixed position while at the same time permitting the flexibility to rotate the unit when desired. Also, it may be seen that the coaxial conductor 18 is of a telescopic form whose length may be varied by the movement of cavity tuning rod 40 which projects exterior to the cavity.

Figure 6:
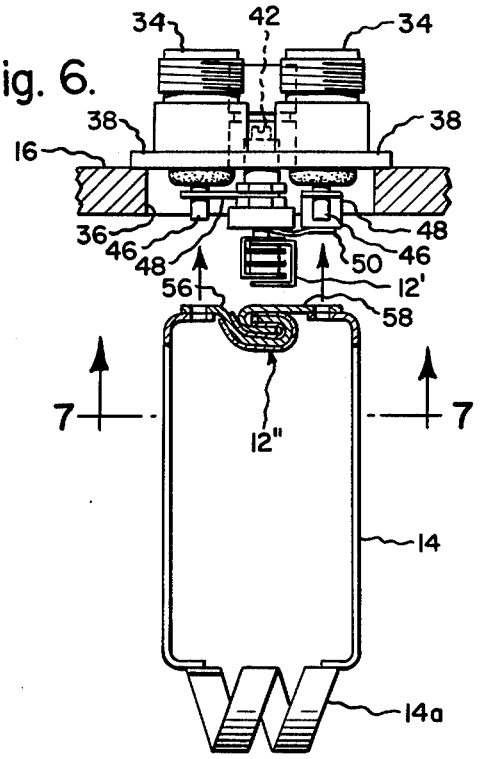
FIG. 6 is an expanded side elevation of another embodiment of the invention showing a different configuration of the lumped constant resonant circuit.
Figure 7:
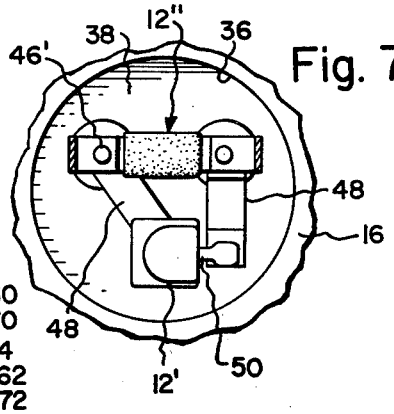
FIG. 7 is an end view of the physical circuit of FIG. 6 taken along the view line 7—7 of FIG. 6.

FIGS. 6 and 7 illustrate an alternate preferred embodiment in which the entire lumped constant circuit is mounted within the cavity itself. This arrangement has the advantage that the entire circuit is exposed to the environment of the cavity in order that differential thermal expansion effects are minimized. FIG. 6 also illustrates a number of other important variations including the variation in which the capacitance 12 includes a fixed capacitor 12″ and a variable capacitor 12′ connected in parallel with one another. With this arrangement, it is possible to make the capacitance of variable capacitor 12′ small relative to the capacitance of fixed capacitor 12″. In this manner, the capacitance of the circuit is basically determined by the value of the fixed capacitance 12″ with the ability to fine tune the overall capacitance by adjustment of the variable capacitance 12′. Fixed capacitor 12″ may consist of an arrangement of inter-leaved conductor straps 56 and 58 with the inter-leaved portions separated by a dielectric spacer 54 commerically available, for example, in the form of a commonly available teflon tape.

Conductor straps 56 and 58 as well as opposite legs of the inductance loop 14 are provided with holes adapted to receive therethrough a portion of the conductor 46 which is the center conductor of the non-directional coaxial cable connector 34. These conductors may be electrically and physically fastened together by any commonly available and well understood technique such as soft solder. As best seen in FIG. 7, variable capacitor 12′ is also connected to conductors 46 by way of conducting straps 48 and capacitor lead 50. If desirable, a helical coil **14*a* may be connected across the bottom of the two legs of inductor 14 in order to increase the total inductance of inductor 14 without increasing the inductive coupling between the inductor and the cavity. Such an arrangement, including loading coil 14*a***, enables the resonant frequency of the lumped constant circuit to be selectively changed to cause the pass band to appear on either side of the notch frequency. Such a technique may be utilized to effect when dealing with VHF frequencies and eliminates the need for a larger and more expensive capacitor.

Figure 8:
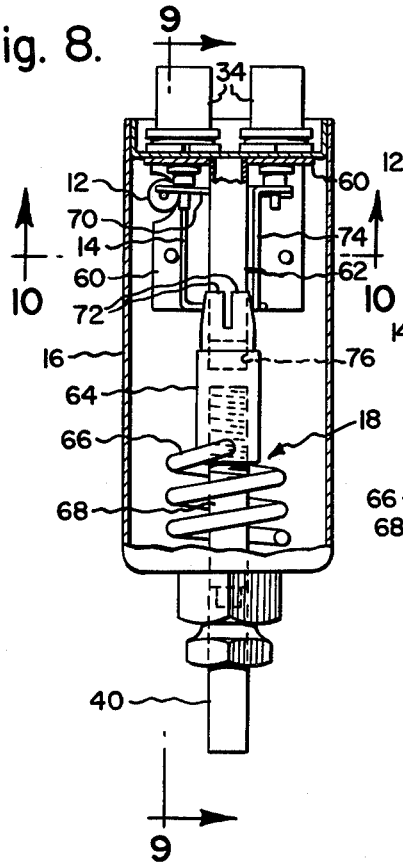
FIG. 8 is a side elevation of yet another embodiment of the invention.
Figure 9:
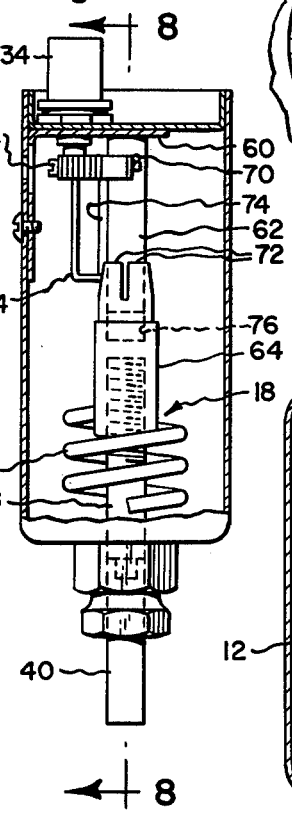
FIG. 9 is a side elevation of the embodiment of FIG. 8 taken along view lines 9—9 of FIG. 8.
Figure 10:
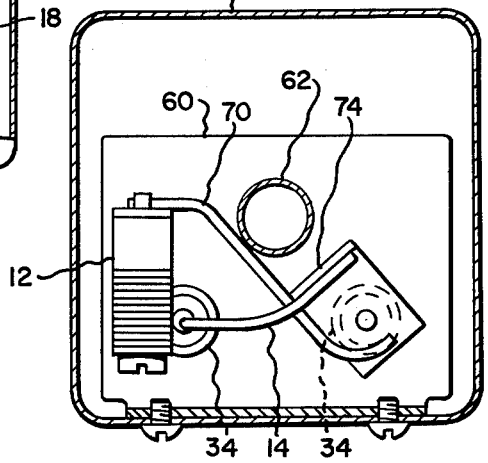
FIG. 10 is an end cross-sectional view of the embodiment of FIG. 8 taken along the view lines 10—10 of FIG. 8.

Turning now to FIGS. 8, 9, and 10, another alternate embodiment is disclosed which incorporates a design intended to compensate for temperature induced variations of the pass and notch frequencies of the notch filter network. In this embodiment, it can be seen that central or coaxial conductor 18 includes a helical conductor coil 66 mounted on a moveable conductor portion 64 which in turn is mounted on a fixed conductor portion 62. It is known in the industry of cavity resonators to provide a helical central conductor such as shown at 66 to shorten the overall physical length of cavity 16 and thereby achieve compactness. However, such designs are subject to the difficulty that the helical conductor 66 experiences relatively large changes in length as a result of thermal expansion and thereby causing the pass frequency to drift. In the present application, where the notch filter network is connected in series with the transmission line, the conducting elements 14 of the inductance and the connecting elements 70 and 74 are physically located within the cavity so that the cavity tends to experience a wide variation in temperature. Accordingly, stability of the pass and notch frequencies becomes a problem with the helical conductor coil 66.

In order to automatically compensate for this thermally caused expansion and contraction of the central conductor 18, a means has been provided for automatically compensating for the lengthwise thermal expansion and contraction of the central lengthwise adjustable conductor 18. Accordingly, the central lengthwise adjustable conductor comprises a telescopic conductor having a first portion 62 fixed to one wall of the cavity and a second portion 64 telescopically extendible with respect to the first portion. First and second portions 62 and 64 respectively are kept in electrical contact by crimp fingers 72 formed in the end of moveable portion 64. Crimp fingers 72 slidingly grip the cylindrical shaft of first portion 62 and maintain continuous electrical contact.

In order to accomodate relative telescopic adjustment between the two parts 62 and 64, portion 64 is provided with an axial void 76 adapted to receive therewithin the center conductor post 62. At the end of the slideable probe 64 opposite to the crimp fingers 72 is a connector shaft 68 which in turn connects with a cavity tuning rod 40. Connector shaft 68 preferably is a dielectric rod whose length and composition have been selected to automatically compensate for the thermal expansion and contraction of the central coaxial conductor 18. Accordingly dielectric connecting rod 68 acts as a means for influencing the position of the second portion of the central conductor 18 in proportion to the ambient temperature within the cavity. It has been determined that a suitable material for dielectric rod 68 with a suitable coefficient of thermal expansion is a cross-linked polystyrene which is commercially available. It should be evident that while the cross-linked polystyrene dielectric rod is one solution available to this specific problem, other solutions are equally possible such as a connecting rod 68 which consists of a plurality of materials such as consisting of a dielectric portion and a conducting portion.

It will be understood that when the length of the connecting rod and its coefficient of thermal expansion have been appropriately chosen, the thermally induced expansion and contraction of the center conductor 18 is automatically compensated for and substantially nullified by the substantially equivalent thermal expansion of the connecting rod 68. Hence, when the thermal growth of the central rod 18 tends to lengthen the conductor 18, an equivalent growth of the dielectric support rod 68 causes the slideable second portion 64 to telescope in the opposite direction by an equivalent distance. One additional measure which it has been found expedient to take to minimize thermal effects on the notch filter network 10 shown in FIGS. 8, 9 and 10 is to carefully select the capacitor 12 to be as free from thermal effects as possible. Thus, it has been found that an air variable capacitor of the piston or plate type is preferred. Such capacitors are commercially available from the Johanson Manufacturing Company, Boonton, N.J. and the E. F. Johnson Co., Waseca, Minn. respectively.

One means for utilizing the notch filter network of the present invention is illustrated in FIG. 4 in which a multicoupler arrangement has been schematically illustrated. It should be noted that the multicoupler illustrated in FIG. 4 shows a transmitter 22 and a receiver 24. However, it should be recognized that the multicoupler of the present invention is not necessarily limited to the duplexer arrangement shown but also applies to a diplexer in which at least two transmitters or two receivers share the same antenna. Accordingly, whereas box 22 has been designated T and box 24 has been designated R to generally indicate transmitter and receiver respectively, it will be understood that boxes 22 and 24 are first and second pieces of electrical apparatus for either transmitting or receiving a signal having a first carrier frequency and a second carrier frequency respectively.

In the multicoupler application, it is desirable to have the first and second carrier frequencies separated as little as possible. Therefore, it is desirable to have notch filter networks which are capable of having their notch and pass frequencies as close together as possible. Generally, a first piece of electrical apparatus 22 is connected to an antenna 30 by means of transmission lines 26 and 32. A second piece of electrical apparatus 24 is also connected to the antenna 30 by transmission lines 32 and 28. Transmission lines 26, 28 and 32 all meet at a common terminal 78. Variable notch filter networks **10*a* and 10*b* according to the present invention are each connected in series in the first and second transmission lines respectively. Each of the notch filter networks 10*a* and 10*b* are spaced from the common terminal 78** by a distance which is approximately equal to a multiple of a half wavelength of a frequency equivalent to the pass frequency of the opposite line.

As will be well understood by a person skilled in the art of radio frequency transmission and reception, it is possible to construct a multicoupler of increased isolation characteristics with a plurality of similar networks connected in series within each of the transmission lines 26 and 28. In this event, each of the plurality of similar networks are spaced one from another by approximately an odd multiple of one quarter of the wavelength of the pass frequency of the opposite line with those networks connected to one line being tuned to approximately the same rejection notch frequency and to approximately the same cavity resonant frequency.

What is claimed is:

1. An electrical filter network for selectively attenuating and passing first and second predetermined closely spaced frequencies respectively when inserted in series in a transmission line, said filter network comprising in combination:

(a) a reactive circuit adapted to be series connected in said transmission line and tuned to be parallel resonant at said first predetermined frequency; and p1
(b) a cavity resonator whose internal field is inductively coupled with said reactive circuit, said cavity resonator being resonant at said second predetermined frequency.

2. The filter network as recited in claim 1 wherein said reactive circuit includes a capacitance and an inductance in parallel with said capacitance and said cavity resonator is inductively coupled to said inductance.

3. The filter network as recited in claim 2 wherein said capacitance is a variable capacitance whereby said reactive circuit may be tuned to vary said first predetermined frequency.

4. The filter network as recited in claim 2 wherein said cavity is a coaxial cavity with a central lengthwise-adjustable conductor for adjusting said second predetermined resonant frequency.

5. The filter network as recited in claim 2 including means for changing the inductive coupling between said inductor and said cavity resonator.

6. The filter network as recited in claim 5 wherein said inductance is mounted within said cavity, thereby linking the field within said cavity.

7. The filter network as recited in claim 6 wherein said means for changing the inductive coupling between said inductor and said cavity resonator means for permitting the variation of position of said inductor within said cavity whereby the field of said cavity linked by said inductor may be increased or decreased.

8. The filter network as recited in claim 7 wherein said means for permitting the variation of position of said inductor within said cavity includes means for rotatably mounting said inductor within said cavity.

9. The filter network as recited in claim 8 wherein said cavity is a coaxial cavity with a central lengthwise adjustable conductor for adjusting said second predetermined resonant frequency.

10. The filter network as recited in claim 9 wherein said capacitance is a variable capacitance whereby said reactive circuit may be tuned to vary said first predetermined frequency.

11. The filter network as recited in claim 2 wherein said capacitance and inductance are both mounted within said cavity.

12. The filter network as recited in claim 3 wherein said variable capacitance includes a fixed capacitor and a variable capacitor connected in parallel.

13. The filter network as recited in claim 12 wherein the capacitance of said variable capacitor is small relative to the capacitance of said fixed capacitor.

14. The filter network as recited in claim 13 wherein said inductance is rotatably mounted within the cavity of said cavity resonator.

15. The filter network as recited in claim 4 further including means connected to said central lengthwise adjustable conductor for automatically compensating for the lengthwise thermal expansion of said central lengthwise adjustable conductor.

16. The filter network as recited in claim 15 wherein said central lengthwise adjustable conductor comprises a telescopic conductor having a first portion fixed to a wall of said cavity and a second portion telescopically extendible with respect to said first portion, said first and second portions remaining in electrical contact at all extensions and wherein said means for automatically compensating for the lengthwise thermal expansion of said central lengthwise adjustable conductor includes means for adjustably positioning said second portion along the axis of said cavity.

17. The filter network as recited in claim 16 wherein said means for adjustably positioning said second portion includes means for influencing the position of said second portion in proportion to the ambient temperature within said cavity.

18. The filter network as recited in claim 17 wherein said means for influencing the position of said second portion in proportion to the ambient temperature within said cavity includes a non-conducting dielectric portion whose length and coefficient of thermal expansion have been chosen to automatically compensate for and substantially nullify the thermal expansion of said central conductor.

19. The filter network as recited in claim 18 wherein said second portion of said central conductor includes a helical coil positioned along the axis of said cavity.

20. A multicoupler comprising:

(a) a first piece of electrical apparatus for transmitting or receiving a signal having a first carrier frequency;

(b) a second piece of electrical apparatus for transmitting or receiving a signal having a second carrier frequency closely spaced from said first carrier frequency;

(c) an antenna shared in common by said first and second pieces of electrical apparatus;

(d) first and second transmission lines coupling said first and second pieces of apparatus respectively to said antenna at a common terminal; and (e) first and second notch filter networks each connected in series in said first and second transmission lines respectively and each being spaced from said common terminal by a distance which is approximately equal to a multiple of a half wavelength of a frequency at the middle of the band of frequencies passed by the opposite line, each of said notch filter networks including:

(1) a reactive circuit tuned to be parallel resonant at a rejection notch frequency substantially equal to one of said first and second frequencies, said reactive circuit including a capacitance and an inductor in parallel; and (2) a cavity resonator inductively coupled to said inductor and tuned to resonate at the other of said first and second frequencies.

21. The multicoupler as claimed in claim 20 wherein said first and second notch filter networks connected in series to said first and second transmission lines are each but one of a plurality of similar networks connected in series to said respective first and second transmission lines, each of said plurality of similar networks spaced one from another by approximately an odd multiple of one quarter of said middle frequency wavelength, those networks connected to said first line all being tuned to approximately the same rejection notch frequency and to apporximately the same cavity resonant frequency and the networks connected to said second line all being tuned to approximately the same rejection notch frequency and to approximately the same cavity resonant frequency.

22. The multicoupler as claimed in claim 20 including means for changing the inductive coupling between each inductor and its respective cavity resonator.

23. The multicoupler as claimed in claim 22 wherein each inductor is mounted within its respective cavity, thereby linking the field within said cavity.

24. The multicoupler as claimed in claim 23 wherein said means for changing the inductive coupling between each inductor and its respective cavity resonator includes means for permitting the variation of position of said inductor within its respective cavity whereby the field of said cavity linked by said inductor may be increased or decreased.

25. The multicoupler as claimed in claim 24 wherein said means for permitting the variation of position of said inductor within its respective cavity includes means for rotatably mounting said inductor within said cavity.

26. The multicoupler as claimed in claim 25 wherein each cavity is a coaxial cavity with a central lengthwise adjustable conductor for adjusting said second predetermined resonant frequency.

27. The multicoupler as claimed in claim 26 wherein each capacitance is a variable capacitance whereby each reactive circuit may be tuned to vary said first predetermined frequency.

28. A method of filtering signals in a through transmission line comprising:

(a) connecting in series in said transmission line a parallel resonant lumped constant circuit having a capacitance and an inductance in parallel;

(b) inductively coupling the inductance of said lumped constant reactive circuit with a resonant cavity;

(c) tuning the resonant frequency of said lumped constant reactive circuit to determine the frequency that is rejected; and (d) tuning the resonant frequency of said resonant cavity to determine the frequency that is passed.

29. The method as claimed in claim 28 further including the step of varying the inductive coupling between said inductance and said cavity to adjustably determine the width of the band of frequencies to be passed.

30. The method as claimed in claim 29 wherein said step of varying the inductive coupling between said inductance and said cavity includes the step of changing the position of said inductance within said cavity.

31. The method as claimed in claim 30 wherein said step of changing the position of said inductance within said cavity includes the step of rotating said inductance within said cavity to change the linkage of said inductance with the field of said cavity.

* * * * *

UNITED STATES PATENT AND TRADEMARK OFFICE

CERTIFICATE OF CORRECTION

PATENT NO. : 4,186,359

DATED : January 29, 1980

INVENTOR(S) : Daniel P. Kaegebein

It is certified that error appears in the above-identified patent and that said Letters Patent are hereby corrected as shown below:

Col. 3, line 24 -"Figs." should be --- Fig. ---.

Col. 3, line 61 - "industance" should be --- inductance ---.

Col. 4, line 56 - "x" before 0.5 should be deleted.

Col. 8, line 53 - After the word "and" "pl" should be deleted.

Col. 9, line 11 - After the word "resonator" please insert the word --- includes ---.

Signed and Sealed this

*Thirteenth* Day of *May 1980*

[SEAL]

*Attest:*

SIDNEY A. DIAMOND

*Attesting Officer*

*Commissioner of Patents and Trademarks*